US011500318B2

(12) United States Patent
Tanaka

(10) Patent No.: US 11,500,318 B2
(45) Date of Patent: Nov. 15, 2022

(54) IMAGE FORMING APPARATUS

(71) Applicant: CANON KABUSHIKI KAISHA, Tokyo (JP)

(72) Inventor: Sumito Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/507,321

(22) Filed: Oct. 21, 2021

(65) Prior Publication Data

US 2022/0128940 A1 Apr. 28, 2022

(30) Foreign Application Priority Data

Oct. 26, 2020 (JP) ..... JP2020-178940

(51) Int. Cl.
*G03G 15/00* (2006.01)

(52) U.S. Cl.
CPC ..... *G03G 15/5062* (2013.01); *G03G 15/5029* (2013.01); *G03G 15/5041* (2013.01); *G03G 15/6573* (2013.01); *G03G 2215/00063* (2013.01)

(58) Field of Classification Search
CPC ..... G03G 15/5029; G03G 15/5041; G03G 15/5062; G03G 15/6573; G03G 2215/00063
See application file for complete search history.

(56) References Cited

U.S. PATENT DOCUMENTS 10,423,111 B2 9/2019 Tanaka
2013/0094039 A1* 4/2013 Takemura ..... H04N 1/6091 358/1.9
2019/0243282 A1* 8/2019 Miyake ..... G03G 15/0822

FOREIGN PATENT DOCUMENTS

JP 2014-107648 A 6/2014

* cited by examiner

*Primary Examiner* — Hoang X Ngo
(74) *Attorney, Agent, or Firm* — Venable LLP

(57) ABSTRACT

An image forming apparatus includes an image forming unit configured to form an image on a sheet; a fixing unit configured to fix the image on the sheet; a reader configured to read a pattern image on the sheet downstream of the fixing unit in a conveying direction in which the sheet is conveyed; and a controller configured to control the image forming unit to form the image and the pattern image on a same sheet, control the fixing unit to fix the image and the pattern image on the same sheet, control the reader to read the pattern image on the same sheet, and control a density of an image to be formed on a sheet subsequent to the same sheet based on a result of reading the pattern image by the reader and reference data.

20 Claims, 6 Drawing Sheets

| CATEGORY | CATEGORY 1 | CATEGORY 2 | CATEGORY 3 | CATEGORY 4 | CATEGORY 5 | CATEGORY 0 |
|---|---|---|---|---|---|---|
| BASIS WEIGHT (g/m^2) | LESS THAN 65 | 65 OR MORE AND LESS THAN 100 | 100 OR MORE AND LESS THAN 150 | 150 OR MORE AND LESS THAN 250 | 250 OR MORE | N/A |
| THICKNESS (μm) | LESS THAN 70 | 70 OR MORE AND LESS THAN 100 | 100 OR MORE AND LESS THAN 170 | 170 OR MORE AND LESS THAN 300 | 300 OR MORE | N/A |
| BEKK SMOOTHNESS (sec) | LESS THAN 10 | 10 OR MORE AND LESS THAN 100 | 100 OR MORE AND LESS THAN 200 | 200 OR MORE AND LESS THAN 500 | 500 OR MORE | N/A |
| VOLUME RESISTIVITY (Ω・cm) | LESS THAN 1e8 | 1e8 OR MORE AND LESS THAN 1e9 | 1e9 OR MORE AND LESS THAN 1e10 | 1e10 OR MORE LESS THAN 1e12 | 1e12 OR MORE | N/A |

FIG. 6

| PAPER SHEET | |
|---|---|
| TYPE | PLAIN PAPER |
| BASIS WEIGHT (g/m^2) | CATEGORY 2 |
| THICKNESS (μm) | CATEGORY 2 |
| BEKK SMOOTHNESS (sec) | CATEGORY 3 |
| VOLUME RESISTIVITY (Ω・cm) | CATEGORY 4 |

FIG. 7

IMAGE FORMING APPARATUS

BACKGROUND OF THE INVENTION

Field of the Invention

The present disclosure relates to an image forming apparatus, for example, a copying machine, a multifunction peripheral, or a printer.

Description of the Related Art

In recent years, the market for on-demand image forming apparatus is expanding. For example, in an offset printing market, an electrophotographic image forming apparatus is becoming widespread. Further, an image forming apparatus having an inkjet system has succeeded in cultivating a wide market for reasons such as a large format, a low initial cost, and an extremely high speed. However, expansion of the market is not easy unless the image quality (hereinafter referred to as "quality") of the preceding image forming apparatus that has served the market is maintained.

The quality includes tone characteristics, granularity, in-plane evenness, letter quality, and color reproducibility (including color stability), for example. It is said that the most important of those is color reproducibility. A human has memories of empirically expected colors (in particular, human skin, sky, and metal, for example), and feels uncomfortable about colors that deviate from this allowed range of memory. Such colors of memory are called "memory colors." Reproducibility of the memory colors is important when a picture or the like is output. In addition, a group of office users who feel uncomfortable about a difference in color between a printed business document and a monitor, and a group of graphic arts users who deal with computer graphics have high demand for color reproducibility including stability of the on-demand image forming apparatus.

An electrophotographic image forming apparatus is generally configured to correct a tone characteristic so that a tone characteristic of an image to be formed matches a target tone characteristic. For the correction of the tone characteristic, a tone correction table, in which a corrected tone value is set for each tone value, is used. A tone characteristic of an image is varied by a change in installation environment of the image forming apparatus and a change with time thereof. Therefore, the image forming apparatus periodically adjusts (calibrates) the tone characteristic to optimize the tone correction table. The calibration is performed through formation of a tone adjustment image on a paper sheet. The tone adjustment image formed on the paper sheet is read by a reading apparatus, for example, a scanner. Based on a difference between a tone characteristic obtained from the read tone adjustment image and the target tone characteristic, the tone correction table is updated.

The tone adjustment image is formed on a paper sheet, for example, in a non-image region excluding an image region, in which an image corresponding to a print job is formed (Japanese Patent Application Laid-open No. 2014-107648). With this configuration, it is not required any more to form the tone adjustment image on a paper sheet that is different from the one on which an image desired by a user is formed, and it is not required to stop print jobs. As a result, a waste sheet can be prevented from being generated.

SUMMARY OF THE INVENTION

Due to a resistance value and surface properties (unevenness on the surface) of the paper sheet, and other causes, even when the same amount of toner is used in printing, an image density on the paper sheet may change in some cases. In order to address the change in image density for each type of paper sheets, when target tone characteristics (meaning the same as "target densities") are held for each type of paper sheets, an increase in storage capacity of a memory, and other costs are generated. To address this problem, in order to increase color stability in units of a print job, there is a method involving setting tone characteristics of the first paper sheet (top paper sheet) of the print job as the target tone characteristics. Paper sheets of the same type are used in one print job. Therefore, the tone characteristics of the top paper sheet are used as the target tone characteristics, and control relative to the image quality of an image on the top paper sheet can be performed to maintain image quality without increasing the storage capacity of the memory.

A result of reading by a reading apparatus in determining the target tone characteristics may vary depending on repeatability of image reading by the reading apparatus. This is why the target tone characteristics vary even when the paper sheets are of the same type. As a result, a deviation may occur in a result of monitoring and adjusting the tone characteristics so that images having appropriate tones cannot be output continuously for a long time.

According to at least one embodiment of the present disclosure, there is provided an image forming apparatus comprising: an image forming unit configured to form an image on a sheet; a fixing unit configured to fix the image on the sheet; a reader configured to read a pattern image on the sheet downstream of the fixing unit in a conveying direction in which the sheet is conveyed; and a controller configured to: control the image forming unit to form the image and the pattern image on a same sheet; control the fixing unit to fix the image and the pattern image on the same sheet; control the reader to read the pattern image on the same sheet; and control a density of an image to be formed on a sheet subsequent to the same sheet based on a result of reading the pattern image by the reader and reference data, wherein, in a case in which a plurality of images are to be formed on a plurality of sheets of the same type, the controller is configured to obtain, as the reference data, a result of reading a first pattern image formed on a first sheet included in the plurality of sheets by the reader, and wherein the controller is configured to determine, after the result of reading the first pattern image by the reader is obtained as the reference data, whether to update the reference data from a result of reading a second pattern image formed on a second sheet of the same type by the reader, based on elapsed time.

Further, according to at least one embodiment of the present disclosure, there is provided an image forming apparatus comprising: an image forming unit configured to form an image on a sheet; a fixing unit configured to fix the image on the sheet; a reader configured to read a pattern image on the sheet downstream of the fixing unit in a conveying direction in which the sheet is conveyed; and a controller configured to: control the image forming unit to form the image and the pattern image on a same sheet; control the fixing unit to fix the image and the pattern image on the same sheet; control the reader to read the pattern image on the same sheet; and control a density of an image to be formed on a sheet subsequent to the same sheet based on a result of reading the pattern image by the reader and reference data, wherein, in a case in which a plurality of images are to be formed on a plurality of sheets of the same type, the controller is configured to obtain, as the reference data, a result of reading a first pattern image formed on a first sheet included in the plurality of sheets by the reader, and wherein the controller is configured to determine, after the result of reading the first pattern image by the reader is obtained as the reference data, whether to update the reference data from a result of reading a second pattern image formed on a second sheet of the same type by the reader, based on the number of image-formed sheets.

Further features of the present invention will become apparent from the following description of exemplary embodiments (with reference to the attached drawings).

BRIEF DESCRIPTION OF THE DRAWINGS

FIG. 6 is an exemplary diagram of paper classification information.

FIG. 7 is an exemplary diagram of physical characteristics.

DESCRIPTION OF THE EMBODIMENTS

A description is given of at least one embodiment of the present disclosure with reference to the drawings. Various limitations that are technically preferred for embodying the present disclosure are placed on the embodiment to be described below, but are not intended to limit the scope of the disclosure to the following embodiment and illustrated examples.

<Image Forming System>

Figure 1:
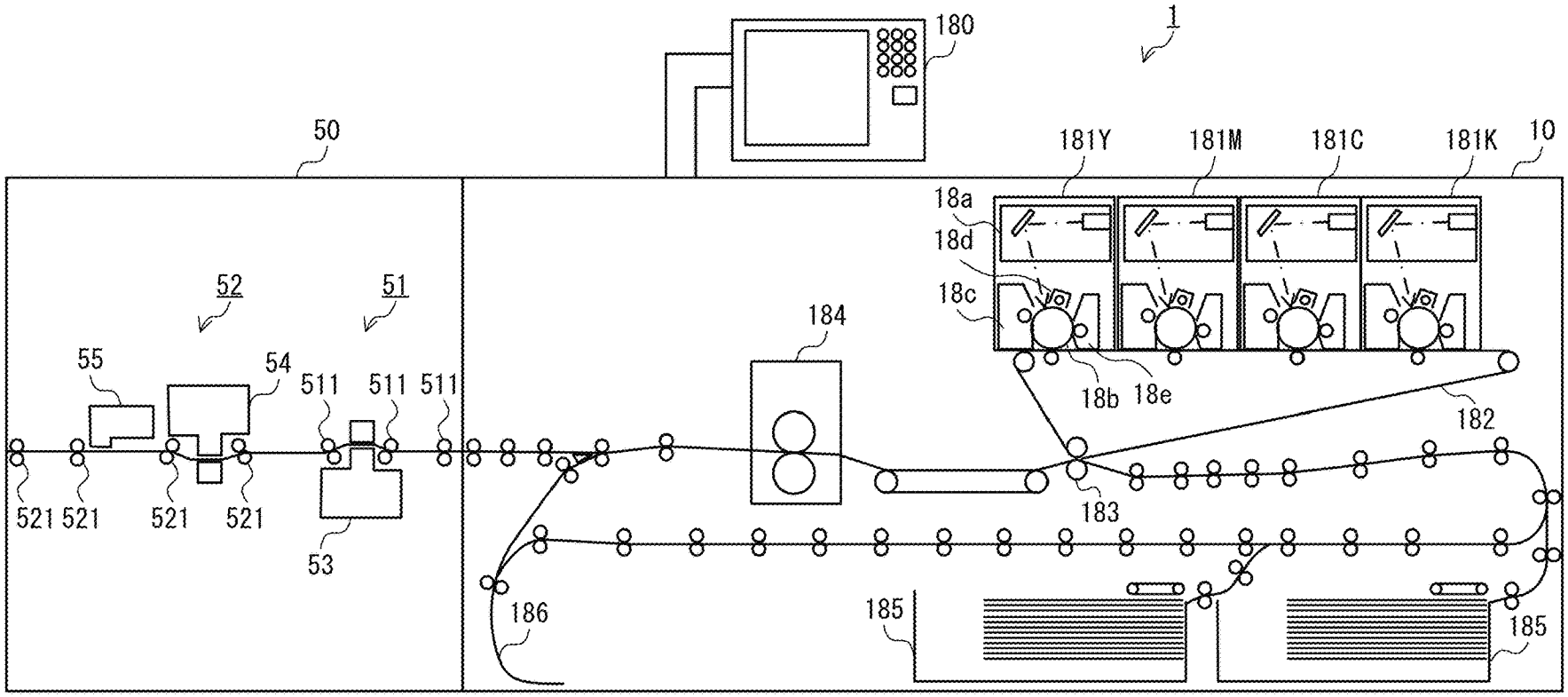
FIG. 1 is a configuration diagram of an image forming system including an image forming apparatus according to at least one embodiment of the present disclosure.

FIG. 1 is a configuration diagram of an image forming system including an image forming apparatus according to at least one embodiment of the present disclosure. An image forming system 1 includes an image forming apparatus 10, a reading apparatus 50, and an operating portion 180. The image forming apparatus 10 forms an image (performs printing) on a paper sheet. The reading apparatus 50 reads tone adjustment images which are test images for tone adjustment formed on the paper sheet. The operating portion 180 is a user interface including an input device and an output device. The input device includes, for example, various key buttons and a touch panel. The output device includes, for example, a display and a speaker.

The image forming apparatus 10 includes four image forming units 181Y, 181M, 181C, and 181K, an intermediate transfer belt 182, secondary transfer rollers 183, a fixing device 184, a plurality of (in this case, two) sheet feeding cassettes 185, and an inverting mechanism 186. The image forming units 181Y, 181M, 181C, and 181K are arranged along a belt surface of the intermediate transfer belt 182. The intermediate transfer belt 182 is an endless transfer member, which is wound around a plurality of rollers to rotate in a predetermined direction (in this embodiment, clockwise direction of FIG. 1). The secondary transfer rollers 183 and the fixing device 184 are arranged on a conveyance path of a paper sheet, which is conveyed from one of the sheet feeding cassettes 185. In each of the sheet feeding cassettes 185, paper sheets of a predetermined size are contained. In this embodiment, two sheet feeding cassettes 185 are provided, and paper sheets contained in the respective sheet feeding cassettes 185 may be of the same type or different types.

The image forming units 181Y, 181M, 181C, and 181K have the same configuration, and are different only in color of an image to be formed. The image forming unit 181Y forms a yellow (Y) image. The image forming unit 181M forms a magenta (M) image. The image forming unit 181C forms a cyan (C) image. The image forming unit 181K forms a black (K) image. Here, the configuration of the image forming unit 181Y is described, and the description of the configurations of the other image forming units 181M, 181C, and 181K is omitted.

The image forming unit 181Y includes an exposure device 18*a*, a photosensitive member 18*b*, a developing device 18*c*, a charging device 18*d*, and a cleaner 18*e*. The photosensitive member 18*b* is a drum-shaped image bearing member having a photosensitive layer on a surface thereof. The photosensitive member 18*b* is configured to rotate about a drum shaft counter-clockwise in FIG. 1. The charging device 18*d* applies a voltage to the photosensitive layer of the rotating photosensitive member 18*b* to uniformly charge the surface of the photosensitive member 18*b*. The exposure device 18*a* irradiates the charged surface of the photosensitive member 18*b* with a laser beam corresponding to a tone value of each pixel of the yellow image. Through the irradiation with the laser beam, an electrostatic latent image is formed on the surface of the photosensitive member 18*b*. The exposure device 18*a* of each of the image forming units of the other colors irradiates a laser beam corresponding to a tone value of each pixel of an image of a corresponding color. As a result, on the photosensitive member 18*b* of each of the image forming units of the other colors, an electrostatic latent image of the corresponding color is formed.

The developing device 18*c* develops the electrostatic latent image formed on the photosensitive member 18*b* with a yellow coloring material (for example, toner). Through the development of the electrostatic latent image, the yellow image is formed on the photosensitive member 18*b*. The developing device 18*c* of each of the image forming units of the other colors develops the electrostatic latent image with a coloring material of a corresponding color. As a result, on the photosensitive member 18*b* of each of the image forming units of the other colors, the image of the corresponding color is formed.

The images formed on the photosensitive members 18*b* of the image forming units 181Y, 181M, 181C, and 181K are transferred to the intermediate transfer belt 182 to be sequentially superimposed on each other. On the intermediate transfer belt 182 having the images of the respective colors transferred thereto, a full-color image is formed. The coloring material remaining on the photosensitive member 18*b* after the transfer is removed by the cleaner 18*e*.

A paper sheet is conveyed from the sheet feeding cassette 185 to the secondary transfer rollers 183 depending on a timing at which the image formed on the intermediate transfer belt 182 is conveyed to the secondary transfer rollers 183 by the rotation of the intermediate transfer belt 182. The secondary transfer rollers 183 serve as a transfer portion for transferring the full-color image from the intermediate transfer belt 182 to the paper sheet. The paper sheet having the image transferred thereto is conveyed to the fixing device 184. The fixing device 184 heats and pressurizes the paper sheet having the image transferred thereto to fix the image on the paper sheet. When an image is to be formed on one side of the paper sheet, this completes image forming processing. When images are to be formed on both sides of the paper sheet, the paper sheet having an image formed on one side thereof is conveyed from the fixing device 184 to the inverting mechanism 186, in which the front and back sides thereof are inverted. The paper sheet having the front and back sides thereof inverted is conveyed again to the secondary transfer rollers 183, and an image is formed on the back side thereof in a similar procedure.

The image forming apparatus 10 performs the image forming processing (printing processing) described above in accordance with a print job. The print job includes data indicating an image to be formed, and image forming conditions, for example, the type of the paper sheet to be used. The exposure device 18*a* irradiates the photosensitive member 18*b* with the laser beam corresponding to the print job. The image forming apparatus 10 conveys a print generated by forming an image on a paper sheet to the reading apparatus 50.

As described later, the image forming apparatus 10 determines whether to form tone adjustment images in addition to an image to be formed on a paper sheet in accordance with a print job. When the tone adjustment images are to be formed in addition, image data (hereinafter referred to as "tone adjustment image data") of the tone adjustment images is added to image data instructed by the print job. The image data is data including a tone value of each pixel of an image of each color. The print having the tone adjustment images formed thereon is read by the reading apparatus 50. Tone characteristics are monitored and adjusted based on results of reading the tone adjustment images.

The reading apparatus 50 includes a first conveyance portion 51, a second conveyance portion 52, a first reading sensor 53, a second reading sensor 54, and a colorimetric portion 55. The first conveyance portion 51 includes a plurality of pairs of conveyance rollers 511, which convey the print supplied from the image forming apparatus 10. The second conveyance portion 52 includes a plurality of pairs of conveyance rollers 521, which convey the print obtained from the first conveyance portion 51. The first reading sensor 53 and the second reading sensor 54 are arranged at positions across the conveyance path along which the print is conveyed. Therefore, the reading apparatus 50 can read images on both sides of the print in one conveyance operation by the first reading sensor 53 and the second reading sensor 54.

The first reading sensor 53 is arranged in the first conveyance portion 51, and reads an image formed on one side of the print passing through the first conveyance portion 51. The first reading sensor 53 outputs read signals (brightness values) of the colors of red (R), green (G), and blue (B) as reading results. The first reading sensor 53 is, for example, an optical sensor. As the first reading sensor 53, a line sensor, for example, a complementary metal oxide semiconductor (CMOS) line sensor or a charge coupled device (CCD) line sensor, is used. When a line sensor is used as the first reading sensor 53, the entire print can be read for a direction orthogonal to a conveying direction of the print (paper sheet).

The second reading sensor 54 is arranged in the second conveyance portion 52, and reads an image formed on the other side of the print passing through the second conveyance portion 52. The second reading sensor 54 has a configuration similar to that of the first reading sensor 53, and outputs read signals (brightness values) of the colors of red (R), green (G), and blue (B) as reading results.

The line sensor reads an image with the direction orthogonal to the conveying direction (sheet passing direction) of the print being one line. Therefore, the direction orthogonal to the conveying direction of the print is a main scanning direction. The conveying direction of the print is a sub-scanning direction.

The colorimetric portion 55 is arranged on a downstream side of the second reading sensor 54 in the conveying direction of the print. The colorimetric portion 55 reads the image on the other side of the print passing through the second conveyance portion 52. The colorimetric portion 55 spectrally measures colors of the tone adjustment images formed on the print, to thereby obtain colorimetric data. The colorimetric data is expressed by a color system, for example, XYZ.

<Control System>

Figure 2:
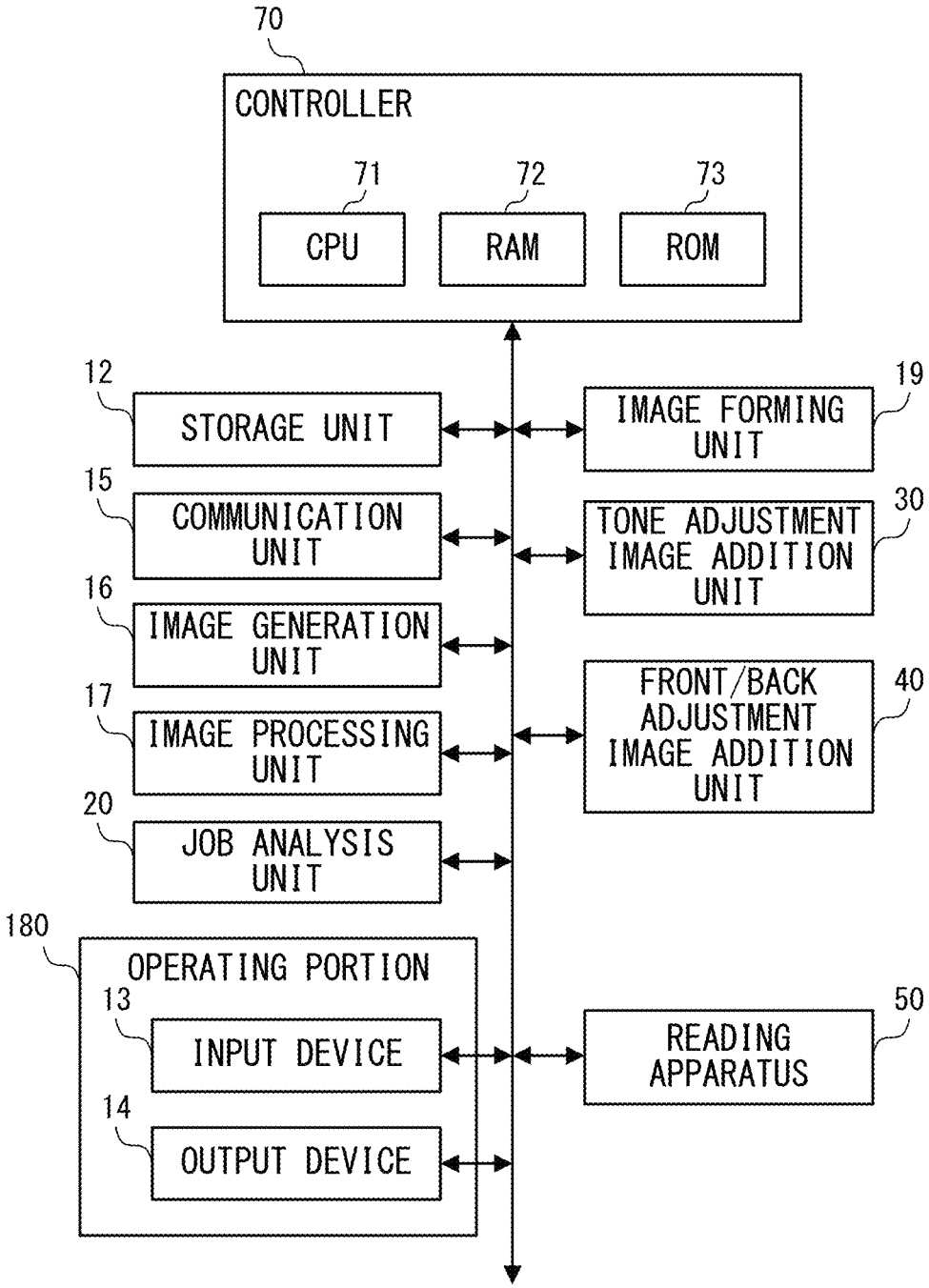
FIG. 2 is an explanatory diagram of a control system.

FIG. 2 is an explanatory diagram of a control system for controlling operation of the image forming system 1. The control system includes a controller 70, a storage unit 12, a communication unit 15, an image generation unit 16, an image processing unit 17, a job analysis unit 20, an image forming unit 19, a tone adjustment image addition unit 30, and a front/back adjustment image addition unit 40. To the controller 70, the operating portion 180 and the reading apparatus 50, which have been described above, are also connected. The operating portion 180 includes an input device 13 and an output device 14.

The controller 70 controls operation of components forming the image forming system 1. The controller 70 includes a central processing unit (CPU) 71, a random access memory (RAM) 72, and a read only memory (ROM) 73. The CPU 71 executes a computer program stored in the ROM 73 or the storage unit 12, to thereby control the operation of the components of the image forming system 1. The RAM 72 provides a work area used when the CPU 71 executes processing, and temporarily stores various programs and various kinds of data, for example.

The storage unit 12 stores the computer program to be executed by the controller 70 (CPU 71), and data used in the processing, for example. The storage unit 12 stores values to be used in monitoring and adjusting of the tone characteristics, which are to be described later, and in front/back adjustment. As the storage unit 12, a hard disk drive, a solid state disk (SSD), or other such mass storage device can be used.

The communication unit 15 is a communication interface for controlling communication to/from an external device, for example, a computer provided outside the image forming system 1. For example, the communication unit 15 receives data (hereinafter referred to as "PDL data") described in a page description language (PDL) from the external device via a network. The PDL data is included in the print job for giving an instruction to form an image, for example.

The job analysis unit 20 analyzes image forming conditions included in the print job obtained through the communication unit 15. The job analysis unit 20 analyzes, from the print job, details of job setting information relating to the entire print job, for example, a name of a document to be printed, the number of prints, specification of a delivery tray as an output destination, order of binders for a job formed of a plurality of binders, a paper type, and the like.

The image generation unit 16 rasterizes the PDL data obtained via the communication unit 15, to thereby generate image data having a bitmap format for each color of yellow, magenta, cyan, and black. The image data contains the tone value for each pixel. The tone value is a data value expressing a grayscale of an image. For example, when the data value has 8 bits, the tone value can express a grayscale level of from 0 to 255.

The image processing unit 17 performs tone correction processing, halftoning, and other image processing on the image data generated by the image generation unit 16. The image processing unit 17 can also generate image data of the colors of yellow, magenta, cyan, and black by converting the colors of read signals of the colors of red (R), green (G), and blue (B), which are results of reading the image by the reading apparatus 50.

The tone correction processing is processing for converting tone values of each color included in the image data so that tone characteristics of an image to be formed on a paper sheet become target tone characteristics. For the tone correction processing, one-dimensional tone correction tables, in each of which an output tone value corresponding to an input tone value is defined, are used. Each of the tone correction tables is a conversion condition for converting an input tone value (input value) of the image data into an output tone value (output value). In order to convert an input tone value of a yellow color component included in the image data, a tone correction table for the yellow color component is used. In order to convert an input tone value of a magenta color component included in the image data, a tone correction table for the magenta color component is used. In order to convert an input tone value of a cyan color component included in the image data, a tone correction table for the cyan color component is used. In order to convert an input tone value of a black color component included in the image data, a tone correction table for the black color component is used. The image processing unit 17 converts not only the image data of a user image (image instructed by the print job), but also the tone adjustment image data of the tone adjustment images to be added to the user image, based on the tone correction tables. Further, types of the halftoning performed by the image processing unit 17 include screen processing using error diffusion processing or an ordered dither method, for example.

The image forming unit 19 controls, under the control of the controller 70, operation of the image forming units 181Y, 181M, 181C, and 181K, the intermediate transfer belt 182, the secondary transfer rollers 183, the fixing device 184, the sheet feeding cassettes 185, and the inverting mechanism 186. The image forming processing on the paper sheet is performed by the image forming unit 19. The image forming unit 19 forms, based on tone values of each pixel of the image data that has been subjected to the image processing by the image processing unit 17, an image of a plurality of colors on the paper sheet. In this embodiment, the image forming unit 19 performs the image forming processing with the use of image data obtained by adding, to the image data that has been subjected to the image processing by the image processing unit 17, the tone adjustment image data and image data (hereinafter referred to as "front/back adjustment image data") of front/back adjustment images. It is assumed that the image is formed to be centered on the paper sheet.

The tone adjustment image addition unit 30 adds the tone adjustment image data to the image data so that the tone adjustment images are to be formed. Further, the tone adjustment image addition unit 30 adds image data (hereinafter referred to as "target tone image data") of the target tone determination images to the image data so that target tone determination images, which are to be described later, are to be formed. The target tone determination images are test images for determining target reading results (reference data). Here, the image processing unit 17 converts the target tone image data based on the tone correction tables. The image forming unit 19 forms the target tone determination images on a paper sheet 80 based on the converted target tone image data. The front/back adjustment image addition unit 40 adds the image data of the front/back adjustment images to the image data so that the front/back adjustment images are to be formed.

<Tone Adjustment Images>

Figure 3:
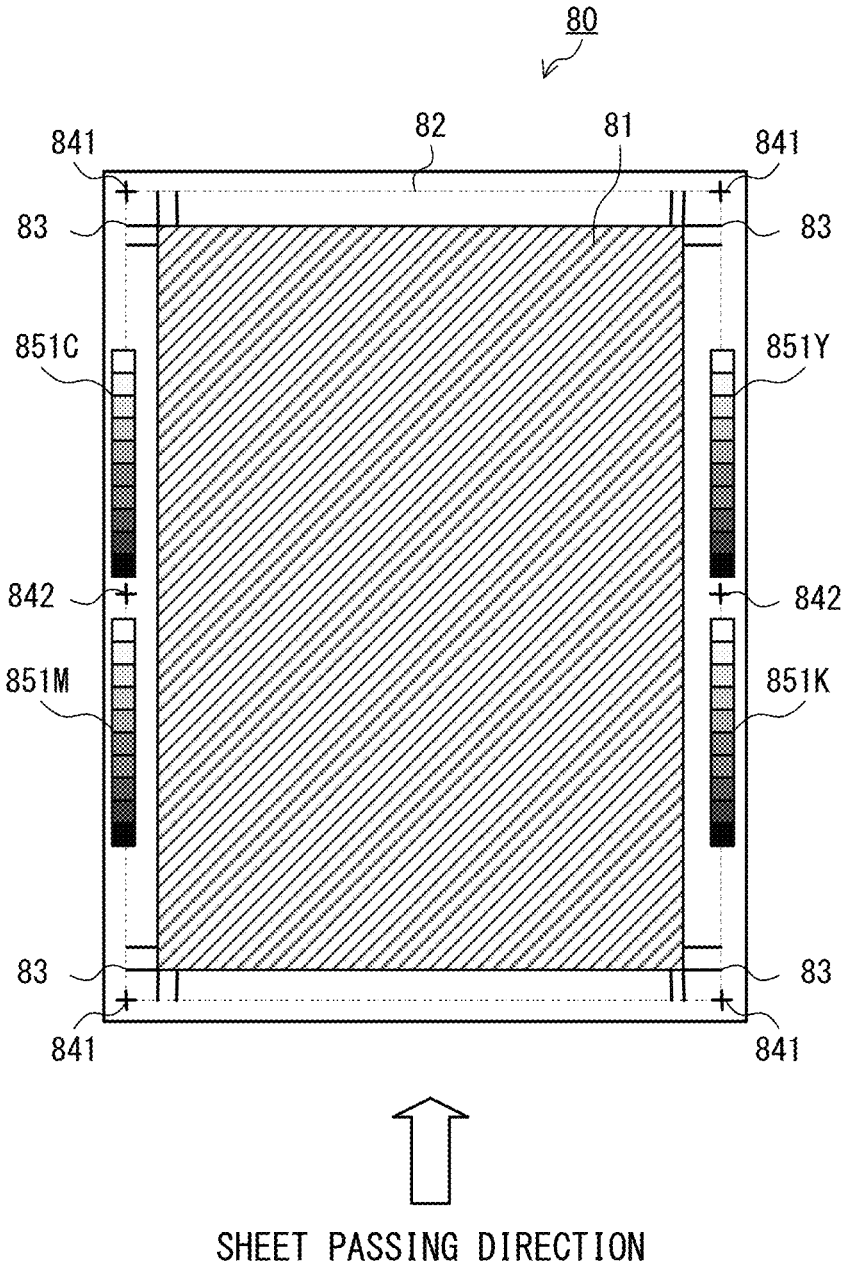
FIG. 3 is an explanatory diagram of tone adjustment images.

FIG. 3 is an explanatory diagram of the tone adjustment images to be formed on a paper sheet by the image forming unit 19. The target tone determination images are images to be formed based on the same input tone values as those of the tone adjustment images. In FIG. 3, an image to be formed on one side of the paper sheet 80 is exemplified. In the paper sheet 80, an image region 81 is provided in the center, and a non-image region 82 is provided between the periphery of the image region 81 and edges of the paper sheet 80. In the image region 81, a user image based on the image data that has been subjected to the image processing by the image processing unit 17 is formed. In the non-image region 82, tone adjustment images 851Y, 851M, 851C, and 851K of the respective colors of yellow, magenta, cyan, and black, front/back adjustment images 841 and 842, and cutting marks 83 are formed. When the colors are not distinguished, the tone adjustment images 851Y, 851M, 851C, and 851K are referred to as "tone adjustment images 851." Read data of the target tone determination images, which is obtained by the reading by the reading apparatus 50, and read data of the tone adjustment images 851, which is obtained by the reading by the reading apparatus 50, are used in update processing in which the tone correction tables are updated. The read data (reference data) of the target tone determination images, which is obtained by the reading by the reading apparatus 50, is hereinafter referred to as "target tones." The cutting marks 83 are added in advance by a user. The cutting marks 83 are each formed of two L-shaped marks overlapping each other, and are formed in the vicinity of four corners of the image region 81. A portion surrounded by the four cutting marks 83 (region enclosed by the broken line) forms a cutting position of the paper sheet 80. The hatching indicating the image region 81 is shown for the purpose of illustration, and is not to be actually formed on the paper sheet 80.

The tone adjustment images 851 may be formed on any of peripheral portions of the paper sheet 80, but are preferably formed, as illustrated in FIG. 3, on both end portions of the paper sheet 80 in the direction orthogonal to the sheet passing direction of the paper sheet 80. In other words, tone adjustment images 851 of any two colors of yellow, magenta, cyan, and black are formed on one end portion region in the direction orthogonal to the sheet passing direction, and tone adjustment images 851 of the remaining two colors are formed on the other end portion region in the direction orthogonal to the sheet passing direction. In this embodiment, the tone adjustment image 851C and the tone adjustment image 851M are formed on the one end portion region in the direction orthogonal to the sheet passing direction, and the tone adjustment image 851Y and the tone adjustment image 851K are formed on the other end portion region in the direction orthogonal to the sheet passing direction. The tone adjustment images 851 are not formed on a leading end portion in the sheet passing direction of the paper sheet 80, and hence curling of the paper sheet 80 during the fixing process can be prevented.

Each of the tone adjustment images 851Y, 851M, 851C, and 851K is formed of patch images of a plurality of tone levels obtained by gradually varying tone values. In FIG. 3, each of the tone adjustment images 851 is formed of patch images of 10 tone levels. Each patch image has a length in the main scanning direction of 8 mm, and a length in the sub-scanning direction of 20 mm, for example. The main scanning direction is the direction orthogonal to the sheet passing direction, and the sub-scanning direction is the sheet passing direction. The plurality of patch images are arrayed in line in the sheet passing direction of the paper sheet 80.

When tone values are expressed in 255 tone levels, a tone value of each of the plurality of patch images arrayed in line of a tone adjustment image 851 are set to any one value of from 0 to 255 so that differences between tone values of each pair of adjacent patch images are equal to each other. Further, tone values of patch images at both ends are set to 0 and 255, respectively. The patch images forming the tone adjustment images 851 are not limited to yellow, magenta, cyan, and black, and may be formed of R, G, B, and process Bk, for example.

In this embodiment, sizes of the tone adjustment images 851 are determined so that the tone adjustment images 851Y, 851M, 851C, and 851K of all four colors are fit on one A3-size paper sheet.

The image formed on the paper sheet 80 is read by the reading apparatus 50. Results of reading the tone adjustment images 851Y, 851M, 851C, and 851K and the front/back adjustment images 841 and 842 by the reading apparatus 50 are stored in the storage unit 12 or the RAM 72 of the controller 70. The stored reading results are analyzed by the controller 70.

The controller 70 monitors and adjusts tone characteristics of the image formed by the image forming unit 19. The controller 70 causes the reading apparatus 50 to read the tone adjustment images 851 formed on the paper sheet 80, and generates modification tables for modifying the tone correction tables based on results of the reading. Then, the controller 70 combines the tone correction tables stored in advance and the modification tables to newly generate tone correction tables. The present disclosure is not limited to the configuration in which the modification tables are generated, and the tone correction tables and the modification tables are combined to update the tone correction tables. For example, there may be adopted a configuration in which the controller 70 directly generates new tone correction tables from the read data of the tone adjustment images 851.

The controller 70 alternately performs the monitoring and the adjustment of the tone characteristics for each paper sheet 80. The present disclosure is not limited to the configuration in which the monitoring and the adjustment of the tone characteristics are alternately performed for each sheet. For example, there may be adopted a configuration in which, every time read data for "n" sheets is obtained, the controller 70 updates the tone correction tables based on read data of "n" tone adjustment images 851.

<Image Forming Processing>

The controller 70 determines, every time the type of paper sheets for use in printing is changed, whether to obtain target tone characteristics (target tones). The target tones are obtained, when the type of paper sheets is changed, from the first print after the change. The image forming apparatus 10 has a configuration in which, in order to increase color stability under the image forming conditions set in the print job, control relative to the target tones is performed so as not to be affected by paper characteristics. Further, the controller 70 obtains the target tones again after time elapsed from when the target tones are obtained reaches a predetermined time. Alternatively, the controller 70 obtains the target tones again after the number of paper sheets having images formed thereon by the image forming apparatus 10 from when the target tones are obtained reaches a predetermined number. This is because, as longer time elapses from when the target tones are obtained, likelihood of the target tones is reduced. The controller 70 does not newly obtain target tones as long as, even when the print job has changed, the type of the paper sheets for use in printing is not changed, and the elapsed time is less than the predetermined time (and the number of image-formed sheets is less than the predetermined number). The type of the paper sheets for use in printing is a type of paper quality of the paper sheets. In the print job, the type of paper sheets for use in printing, for example, plain paper, recycled paper, or coated paper, is set. The type of paper sheets is classified, for example, by a basis weight, a thickness, Bekk smoothness (surface properties of the paper sheet), a volume resistivity, a paper size, and whiteness (color of the paper sheet).

A variety of paper types are available in the market, and hence in the print job, the same number of types of paper sheets as the number of types can be set. Paper types that can be used in the image forming system 1 can be registered in advance by the user through the input device 13. Registration information of the paper types is stored in, for example, the storage unit 12.

The reading apparatus 50 including the first reading sensor 53 and the second reading sensor 54, which are line sensors, reads the tone adjustment images with a range of 4 mm by 4 mm in 600 dpi being one unit, for example. A result of reading a patch image of one tone in this case is two sets of data, which are a result of reading two units, because 2-mm widths in both end portions in the sub-scanning direction of the patch image are not read due to the effects of optical flare and toner edge effects. An average value of the two sets of data is adopted as a read signal (brightness value) of the patch image. In addition to the average value, a maximum value or a minimum value may be adopted for the read signal (brightness value). The method of calculating the read signal is determined based on the configuration of the reading apparatus 50 and the features of the image forming apparatus 10.

As described above, in this embodiment, sizes of the tone adjustment images 851 are determined in a range in which the tone adjustment images 851 of all four colors are fit on one A3-size paper sheet fed longitudinally. Normal tone adjustment images 851 are printed page by page, and tone correction is performed based on differences between tones obtained from read signals thereof and the target tones. When the target tones obtained the last time and the target tones obtained this time are different, effects of one error in reading the tone adjustment images 851 disadvantageously appear in the tones of the formed image.

Figure 4:
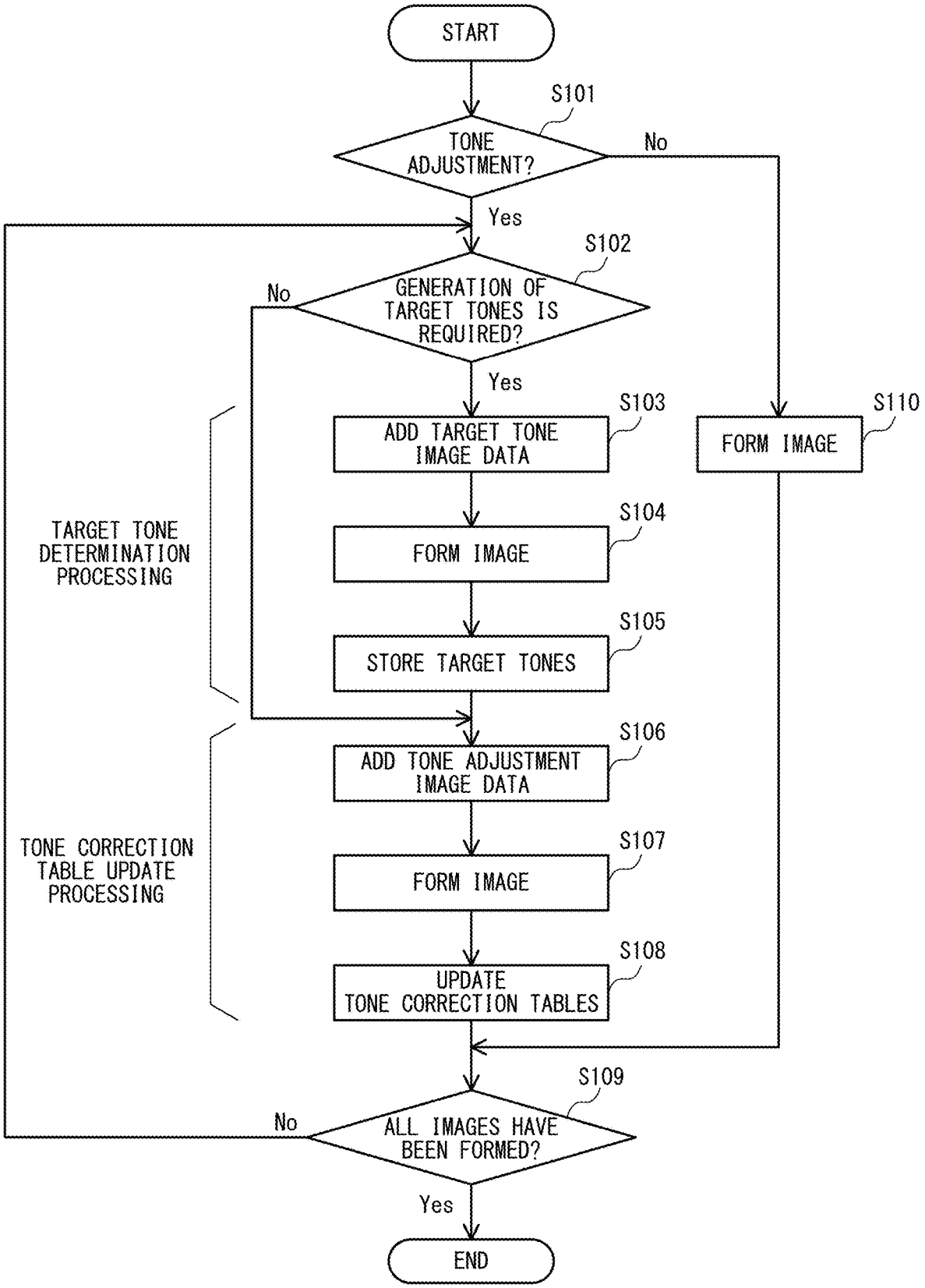
FIG. 4 is a flow chart for illustrating image forming processing.

FIG. 4 is a flow chart for illustrating image forming processing in this embodiment. This image forming processing is performed for each print job. When a print job is transferred to the image forming apparatus 10, the CPU 71 reads and executes an image forming processing program stored in the ROM 73. In this processing, the tone adjustment images 851 of FIG. 3 are used in the processing of updating the tone correction tables.

When the print job is transferred to the image forming apparatus 10, the CPU 71 first determines whether to perform tone adjustment (Step S101). Whether to perform the tone adjustment is set in advance by the user with the use of the input device 13. Details of the settings are stored in the RAM 72, and the CPU 71 makes the determination by referring to the RAM 72.

When the tone adjustment is to be performed (Step S101: Yes), the CPU 71 determines whether generation of the target tones is required (Step S102). In the processing of Step S102, the CPU 71 determines whether the type of paper sheet on which an image is to be formed matches one of the types of paper sheets which are stored in the storage unit 12 and for which target tones are set. When the type of paper sheet on which the image is to be formed and one of the types of paper sheets for which the target tones are set match, the CPU 71 determines whether time elapsed from when the target tones corresponding to the type of paper sheet are generated is less than a predetermined time. When the type of paper sheet on which the image is to be formed and one of the types of paper sheets which are stored in the storage unit 12 and for which the target tones are set match, and the time elapsed from when the target tones are generated is less than the predetermined time, the CPU 71 determines that the generation of the target tones is not required.

In contrast, when the type of paper sheet on which the image is to be formed and one of the types of paper sheets for which the target tones are set do not match, the CPU 71 executes target tone determination processing. Alternatively, even if the type of paper sheet on which the image is to be formed and one of the types of paper sheets for which the target tones are set match, when the time elapsed from when the target tones are generated is the predetermined time or longer, the CPU 71 executes the target tone determination processing.

When starting the target tone determination processing (Step S102: Yes), the CPU 71 first adds, by the tone adjustment image addition unit 30, to image data for the first paper sheet generated by the image generation unit 16, the target tone image data for determining the target tone of the print job (Step S103). The target tone image data is the same as the tone adjustment image data. The CPU 71 performs, by the image forming unit 19, the image forming processing on the paper sheet based on the image data having the target tone image data added thereto (Step S104). As a result, as exemplified in FIG. 3, a print obtained by forming, on the paper sheet 80, the tone adjustment images 851 and the image instructed by the print job is generated. The print is conveyed to and read by the reading apparatus 50. The CPU 71 obtains a brightness value from a result of reading (read signal) the tone adjustment images 851 by the reading apparatus 50. The CPU 71 determines the obtained brightness value as the target tone, and stores the target tone in the RAM 72 (Step S105).

The result of reading the target tone determination images 851 consists of nine pieces of data for each patch image, that is, for each tone level of one color. The CPU 71 sets an average value of seven pieces of data excluding the upper and lower limit values from the nine pieces of data as a brightness value of the patch image. As a result, the brightness value of the patch image can be determined correctly, and the target tone is determined with high accuracy.

When the target tone determination processing ends, the CPU 71 starts the processing of updating the tone correction tables. When starting the processing of updating the tone correction tables, the CPU 71 first adds, to image data generated by the image generation unit 16, the tone adjustment image data by the tone adjustment image addition unit 30 (Step S106). The CPU 71 performs, by the image forming unit 19, the image forming processing on a paper sheet based on the image data having the tone adjustment image data added thereto (Step S107). As a result, as exemplified in FIG. 3, a print obtained by forming, on the paper sheet 80, the tone adjustment images 851 and the image instructed by the print job is generated. The print is conveyed to and read by the reading apparatus 50. The CPU 71 obtains a brightness value from a result of reading the tone adjustment images 851 by the reading apparatus 50. The CPU 71 updates the tone correction tables based on a difference between the obtained brightness value and the target tone (Step S108). As a result, based on the tone correction tables generated in Step S108, densities of images to be formed on paper sheets subsequent to the paper sheet 80, which are of the same type as the paper sheet 80, are controlled.

The CPU 71 determines whether all images included in the print job have been formed on paper sheets (Step S109). When all the images included in the print job have been formed on the paper sheets (Step S109: Yes), the CPU 71 ends the image forming processing.

When not all the images included in the print job have been formed on paper sheets (Step S109: No), the CPU 71 repeatedly executes the processing of Step S102 and the subsequent steps until all the images included in the print job are formed on the paper sheets.

When the tone adjustment is not to be performed (Step S101: No), the CPU 71 performs the image forming processing on a paper sheet by the image forming unit 19 based on the image data generated by the image generation unit 16 (Step S110), and the process proceeds to Step S109. When the tone adjustment is not to be performed, the tone adjustment images 851 are not printed on the paper sheet.

As described above, when the tone adjustment images 851 are formed on the paper sheet to perform the tone adjustment, whether to perform the processing of determining the target tones is determined based on whether the paper type is the same as in the previous print job. When the paper type is the same, and the time elapsed from when the target tones are generated is less than the predetermined time, the target tones are not updated, to thereby suppress a measurement error caused by the reading apparatus 50 and deviations from the target tones caused by fluttering during conveyance of the paper sheet. Therefore, a variation in image quality in a case in which images are formed with the same paper type in different print jobs is suppressed.

Figure 5:
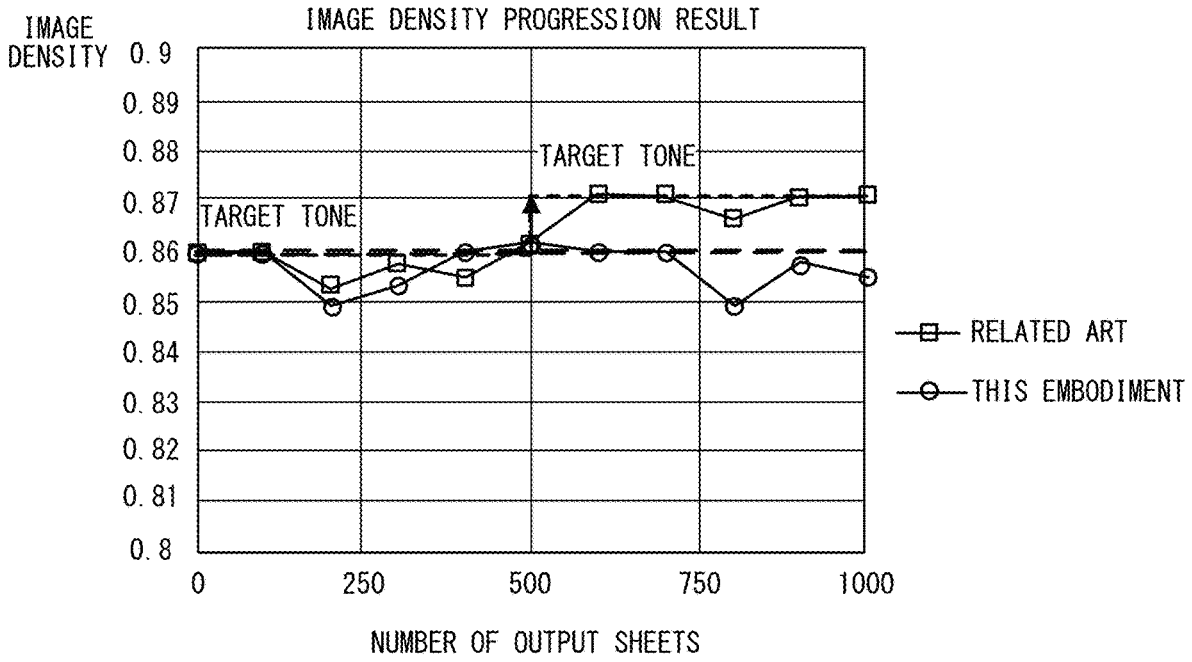
FIG. 5 is an explanatory graph of effects.

FIG. 5 is an explanatory graph of effects of this embodiment. In this example, in a print job, conditions under which the number of sheets to be printed is 500, and the target tones are obtained from the first print are defined. Two consecutive print jobs using the same paper type are performed. In FIG. 5, printing on 500 sheets in a print job using the same paper type is performed two times, and hence the number of output sheets totals 1,000.

In a comparative example, target tones are obtained from the first print and the 501st print at the start of each print job. As a result, between the first print job and the next print job, a difference of about 0.01 (image densities of 0.86 and 0.87) occurs in target tones in the comparative example. In this manner, in the comparative example, different target tones are set for paper sheets of the same type between the print jobs.

In this embodiment, the target tones are set based on the first print in the first print job, but the target tones are not set from the first print in the second print job. As a result, the effects of a variation in reading by the reading apparatus 50 are suppressed, and hence a deviation in image density is suppressed. Consequently, image quality of the prints is kept constant. Also, when the number of consecutive print jobs is three or more, as long as the paper type is the same, the target tones are set based on the first print in the first print job, and the target tones are not set in the subsequent print jobs.

The condition for updating the target tones is to perform the update preferably on a sheet other than the first paper sheet in the print job. The update of the target tones is relative control that is completed in the print job, and is performed when an environment (temperature and humidity) in which the image forming apparatus 10 is installed has changed significantly, or when the power is turned off. Therefore, the update of the target tones is performed after the time elapsed from when the target tones are generated is the predetermined time or more, or after the number of image-formed sheets from when the target tones are generated reaches the predetermined number or more. The update of the target tones is also performed when the tone correction is performed on an absolute standard. The number of image-formed sheets is determined by, for example, the CPU 71 counting paper sheets delivered on the delivery tray.

The image forming apparatus 10 according to this embodiment as described above determines whether to obtain new target tones depending on whether paper sheets to be used are of the same type. Therefore, the target tones are set at an optimal timing. When the target tones are determined, the image forming apparatus 10 performs the tone correction based on the differences between the results of reading the tone adjustment images and the target tones, and images of appropriate colors can thus be output for a long time. In this manner, the image forming apparatus 10 obtains the target tones required for the tone correction at an appropriate timing so that images of appropriate colors can be output for a long time.

Further, the image forming apparatus 10 is not limited to the configuration in which the target tone determination processing is executed when the time elapsed from when the target tones are generated is the predetermined time or more. The image forming apparatus 10 may execute the target tone determination processing when, for example, the time from when the tone adjustment images 851 for updating the target tones are formed exceeds a predetermined time. After the results of reading by the reading apparatus 50 are obtained as the target tones, the image forming apparatus 10 determines whether to update the target tones from the read data of the tone adjustment images 851 formed on the subsequent sheets based on the elapsed time.

Further, the image forming apparatus 10 is not limited to the configuration in which the target tone determination processing is executed after the number of image-formed sheets from when the target tones are generated reaches the predetermined number or more. The image forming apparatus 10 may execute the target tone determination processing after the number of paper sheets on which images are formed by the image forming apparatus 10 after the tone adjustment images 851 for updating the target tones are formed exceeds a predetermined number, for example. The image forming apparatus 10 determines whether to update, after the results of reading by the reading apparatus 50 are obtained as the target tones, the target tones from read data of tone adjustment images 851 formed on the subsequent sheets, based on the number of image-formed sheets.

<Modification Example>

The target tones may be obtained in consideration of not only the paper type or the timing at which the paper type is specified, but also paper settings. For example, when any one of the three conditions (e.g., the paper type, the timing at which the paper type is specified, and the paper settings) is the same between a preceding print job and the subsequent print job, the target tones are not obtained again in the subsequent print job. Those conditions can be set through the operating portion 180. When the conditions on whether to obtain the target tones are customizable to be added or deleted through the operating portion 180, usability is increased.

The timing at which the paper type is specified is a timing at which the paper type for use in printing for the first time in a predetermined period is specified. The predetermined period is, for example, 8 hours, 24 hours (1 day), 1 week, or 1 hour, and is appropriately set depending on a status of use by the user through the operating portion 180. For paper sheets of the type for which the target tones are obtained in the predetermined period, the target tones are not obtained when the paper sheets are used for printing in the predetermined period again. In other words, when images are to be formed on paper sheets of the same paper type or having the same paper setting as the paper sheets used in print jobs in the predetermined period, the target tones are not obtained.

The paper settings are a type of a paper sheet or physical characteristics of the paper sheet, which are more detailed than the paper type. Even for plain paper, for example, paper sheets have various surface properties. The surface properties of the paper sheets affect image density characteristics of images to be formed. The paper settings are input through the operating portion 180. The user inputs the paper settings in accordance with a paper setting screen displayed on the output device 14 of the operating portion 180. On the paper setting screen, for example, the paper types registered with the image forming apparatus 10 are displayed as a list. When selections are made from the list through the input device 13, paper settings of the selected paper type can be made. Alternatively, the paper settings may be made with information for identifying the type of the paper sheets, for example, a product code of the paper sheets.

The image forming apparatus 10 can access an external database through the communication unit 15. The communication unit 15 performs communication using an existing communication network, for example, a local area network (LAN), the Internet, or a dedicated line. In a case in which types of usable paper sheets are not registered in advance, the image forming apparatus 10 cannot display the registered types of paper sheets as a list. In this case, the image forming apparatus 10 accesses the database to display a list of types of paper sheets registered with the database on the output device 14. When the database server has obtained the paper type selected through the input device 13 from the image forming apparatus 10, the database server transmits physical characteristics of the paper type to the image forming apparatus 10. The physical characteristics include, for example, a basis weight, a thickness, Bekk smoothness (surface properties of the paper sheet), a volume resistivity, sizing, and whiteness (color of the paper sheet).

FIG. 6 is an exemplary diagram of paper classification information stored in the database. In the paper classification information, physical characteristics of Categories 1 to 5 are set. FIG. 7 is an exemplary diagram of physical characteristics retrieved by the database server in accordance with the paper type obtained from the image forming apparatus 10. The data server that has obtained "plain paper" as the paper type extracts categories of a basis weight, a thickness, Bekk smoothness, and a volume resistivity from the paper classification information. The image forming apparatus 10 obtains the physical characteristics of the extracted categories from the database.

When the paper type is the same even in different print jobs, the controller 70 determines the different print jobs to be the same job, and does not obtain the target tones. The controller 70 can obtain the target tones at a more appropriate timing based on whether the paper type specified in the print job is a type of a paper sheet that is used for the first time.

In the processing described above, in a case of a print job in which the tone adjustment images 851 are printed on a paper sheet 80 to perform the processing of updating the tone correction tables, new target tones are not obtained as long as the paper type is the same, and time elapsed from the timing at which the paper type is specified is less than predetermined time. Therefore, appropriate target tones can be obtained while suppressing the effects of a measurement error caused by the reading apparatus 50, a variation caused by unevenness on the surface of the paper sheet, and fluttering of the paper sheet caused by the conveyance of the paper sheet on the reading results. When the target tones are determined, the image forming apparatus 10 can output images of appropriate colors for a long time by updating the tone correction tables with the differences between the results of reading the tone adjustment images 851 and the target tones. In this manner, the image forming apparatus 10 can obtain the target tones required for the tone correction at appropriate timings, and output the images of the appropriate colors for a long time.

The image forming apparatus 10 described above determines, when the paper type is not significantly different, that there is no change in paper characteristics, and does not update the target tones. Further, it is highly likely that paper sheets fed from the same sheet feeding cassette 185 are paper sheets of the same type unless an opening/closing operation of the sheet feeding cassette 185 is performed. Therefore, there may be adopted a configuration in which, when paper sheets of the same sheet feeding cassette 185 are used for printing even in different print jobs, the target tones are not updated.

Further, the controller 70 does not obtain the target tones when the type of paper sheet on which an image is to be formed and one of the types of paper sheets which are stored in the storage unit 12 and for which the target tones are set match, and the time elapsed from when the target tones are generated is less than the predetermined time. However, the controller 70 may have a configuration in which the target tones are not obtained when the type of paper sheet on which an image is to be formed and one of the types of paper sheets which are stored in the storage unit 12 and for which the target tones are set match.

In the above description, the image forming apparatus 10 and the reading apparatus 50 are different apparatus, but those apparatus may be integrally formed. For example, the first reading sensor 53 and the second reading sensor 54 may be arranged on the downstream side of the fixing device 184 in a conveying direction of the paper sheet in the image forming apparatus 10.

The image forming system 1 may include a sheet processing device for performing stapling, punching, folding, bookbinding, and other sheet processing, on a downstream side in a sheet conveying direction of the reading apparatus 50. The sheet processing device may execute the sheet processing only when instructed by the controller 70. When no instruction is given by the controller 70, and the sheet processing is not to be performed, the sheet processing device delivers the conveyed paper sheet directly.

Further, the first reading sensor 53 reads the image of the paper sheet from below, and the second reading sensor 54 and the colorimetric portion 55 read the image of the paper sheet from above, but the directions may be opposite. Further, the cutting marks 83 are included in the image to be formed based on the image data, but the cutting marks 83 may not be included. In this case, the image forming apparatus 10 may be configured to add cutting mark information to image data so that the cutting marks 83 are to be formed at cutting positions of a paper sheet, on which an image is to be formed based on the image data.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-178940, filed Oct. 26, 2020, which is hereby incorporated by reference herein in its entirety.

What is claimed is:

1. An image forming apparatus comprising:

an image forming unit configured to form an image on a sheet;

a fixing unit configured to fix the image on the sheet;

a reader configured to read a pattern image on the sheet downstream of the fixing unit in a conveying direction in which the sheet is conveyed; and a controller configured to:

control the image forming unit to form the image and the pattern image on a same sheet;

control the fixing unit to fix the image and the pattern image on the same sheet;

control the reader to read the pattern image on the same sheet; and control a density of an image to be formed on a sheet subsequent to the same sheet based on a result of reading the pattern image by the reader and reference data, wherein, in a case in which a plurality of images are to be formed on a plurality of sheets of the same type, the controller is configured to obtain, as the reference data, a result of reading a first pattern image formed on a first sheet included in the plurality of sheets by the reader, and wherein the controller is configured to determine, after the result of reading the first pattern image by the reader is obtained as the reference data, whether to update the reference data from a result of reading a second pattern image formed on a second sheet of the same type by the reader, based on elapsed time.

2. The image forming apparatus according to claim 1, wherein the first sheet includes a sheet on top of the plurality of sheets.

3. The image forming apparatus according to claim 1, wherein the elapsed time is time from when the reference data is generated from the result of reading the first pattern image by the reader, and wherein the controller is configured to update, when the elapsed time exceeds a predetermined time, the reference data from the result of reading the second pattern image by the reader.

4. The image forming apparatus according to claim 1, wherein the elapsed time is a time from when the first pattern image is formed, and wherein the controller is configured to update, when the elapsed time exceeds a predetermined time, the reference data from the result of reading the second pattern image by the reader.

5. The image forming apparatus according to claim 1, further comprising a conversion unit configured to convert image data based on a conversion condition, wherein the image forming unit is configured to form the image based on the image data converted by the conversion unit, and wherein the controller is configured to generate the conversion condition based on the result of reading the pattern image by the reader and the reference data in order to control the density.

6. The image forming apparatus according to claim 1, wherein the type of the sheet includes information on a basis weight of the sheet.

7. The image forming apparatus according to claim 1, wherein the type of the sheet includes information on a thickness of the sheet.

8. The image forming apparatus according to claim 1, wherein the type of the sheet includes information on surface properties of the sheet.

9. The image forming apparatus according to claim 1, wherein the type of the sheet includes information on a volume resistivity of the sheet.

10. The image forming apparatus according to claim 1, wherein the type of the sheet includes information on a color of the sheet.

11. An image forming apparatus comprising:

an image forming unit configured to form an image on a sheet;

a fixing unit configured to fix the image on the sheet;

a reader configured to read a pattern image on the sheet downstream of the fixing unit in a conveying direction in which the sheet is conveyed; and a controller configured to:

control the image forming unit to form the image and the pattern image on a same sheet;

control the fixing unit to fix the image and the pattern image on the same sheet;

control the reader to read the pattern image on the same sheet; and control a density of an image to be formed on a sheet subsequent to the same sheet based on a result of reading the pattern image by the reader and reference data, wherein, in a case in which a plurality of images are to be formed on a plurality of sheets of the same type, the controller is configured to obtain, as the reference data, a result of reading a first pattern image formed on a first sheet included in the plurality of sheets by the reader, and wherein the controller is configured to determine, after the result of reading the first pattern image by the reader is obtained as the reference data, whether to update the reference data from a result of reading a second pattern image formed on a second sheet of the same type by the reader, based on the number of image-formed sheets.

12. The image forming apparatus according to claim 11, wherein the first sheet includes a sheet on top of the plurality of sheets.

13. The image forming apparatus according to claim 11, wherein a number of image-formed sheets is a number of sheets on which images are formed by the image forming unit from when the reference data is generated from the result of reading the first pattern image by the reader, and wherein the controller is configured to update, when the number of image-formed sheets exceeds a predetermined number, the reference data from the result of reading the second pattern image by the reader.

14. The image forming apparatus according to claim 11, wherein a number of image-formed sheets is a number of sheets on which images are formed by the image forming unit after the first pattern image is formed, and wherein the controller is configured to update, when the number of image-formed sheets exceeds a predetermined number, the reference data from the result of reading the second pattern image by the reader.

15. The image forming apparatus according to claim 11, further comprising a conversion unit configured to convert image data based on a conversion condition, wherein the image forming unit is configured to form the image based on the image data converted by the conversion unit, and wherein the controller is configured to generate the conversion condition based on the result of reading the pattern image by the reader and the reference data in order to control the density.

16. The image forming apparatus according to claim 11, wherein the type of the sheet includes information on a basis weight of the sheet.

17. The image forming apparatus according to claim 11, wherein the type of the sheet includes information on a thickness of the sheet.

18. The image forming apparatus according to claim 11, wherein the type of the sheet includes information on surface properties of the sheet.

19. The image forming apparatus according to claim 11, wherein the type of the sheet includes information on a volume resistivity of the sheet.

20. The image forming apparatus according to claim 11, wherein the type of the sheet includes information on a color of the sheet.

* * * * *